United States Patent [19]

Castonguay et al.

[11] 4,075,584

[45] Feb. 21, 1978

[54] UNDERVOLTAGE RELEASE DEVICE FOR CIRCUIT BREAKERS

[75] Inventors: Roger N. Castonguay, Bristol; Charles L. Jencks, Avon, both of Conn.

[73] Assignee: General Electric Company, New York, N.Y.

[21] Appl. No.: 730,147

[22] Filed: Oct. 6, 1976

[51] Int. Cl.[2] ..... H01H 83/00

[52] U.S. Cl. ..... 335/20; 361/92

[58] Field of Search ..... 335/20, 21, 38, 41, 335/174; 361/92

[56] References Cited

U.S. PATENT DOCUMENTS

| | | | |
|---|---|---|---|
| 3,723,924 | 3/1973 | Shaffer et al. | 335/20 X |
| 3,806,846 | 4/1974 | Powell | 335/20 |
| 4,016,518 | 4/1977 | Lang et al. | 335/20 X |

*Primary Examiner*—George Harris

*Attorney, Agent, or Firm*—Robert A. Cahill; Walter C. Bernkopf; Frank L. Neuhauser

[57] ABSTRACT

In a circuit breaker undervoltage release device, a spring powered trip slide is held in a latched position by a latch lever while the plunger of a solenoid is magnetically held in a seated position against the bias of a calibrated return spring. In the event of an undervoltage condition, the spring retracts the plunger, causing the latch lever to release the trip slide, which then moves to trip the breaker. Opening movement of the breaker mechanism first actuates a reset lever to load a reset spring and then returns the slide to its latched position. As the latch lever regains latching control of the slide, the reset spring discharges to snap the plunger to its seated position.

12 Claims, 6 Drawing Figures

UNDERVOLTAGE RELEASE DEVICE FOR CIRCUIT BREAKERS

BACKGROUND OF THE INVENTION

An undervoltage release (UVR) device is a well known circuit breaker accessory utilized to protect electrical equipment against potential damage from an abnormal undervoltage condition. Typically, a UVR device takes the form of a solenoid energized from the line voltage to magnetically detain its plunger in a seated position against the bias of a calibrated return spring. If line voltage drops to an undesirably low level for longer than a momentary period, the plunger detaining magnetic force decreases to the point where the return spring force becomes overpowering. The plunger thus springs to a retracted position, initiating tripping of the circuit breaker to its open circuit condition. After the undervoltage condition has been corrected, it is necessary to reset the UVR device. This reset operation entails forceably returning the plunger to its seated position in order that the magnetic force generated by the solenoid can regain control of the plunger such as to retain it in its seated position against the return spring bias. One manner of effecting this reset operation is manually by depression of a button to force the plunger back to its seated position. However, the preferred method is to utilize the opening movement of the circuit breaker operating mechanism to return the plunger to its seated position and hold it there against the return spring bias pending the return of normal line voltage. U.S. Pat. Nos. 3,162,740; 3,293,577; 3,360,751 and 3,453,568 are exemplary of this prior art approach to resetting a UVR device.

In the typical circuit breaker, the opening movement of its mechanism is quite violent, necessarily so to achieve the abrupt contact separation required in most applications. In order that the full impact of the breaker mechanism opening movement not be communicated to the UVR device, resilient means, typically in the form of a spring, is generally interposed between the breaker mechanism and the UVR plunger. Such resilient means yields to cushion the force of impact of the plunger upon arrival at its seated position, as well as to accommodate overtravel of the breaker mechanism in its opening movement. Thus, the resilient means also accommodates less strigent manufacturing tolerances.

The principle problem encountered in the field with UVR devices is their failure to reset. If the UVR device cannot be reset, its plunger remains retracted by the return spring, and thus reclosure of the breaker contacts to restore electrical service is inhibited. Reset failures are generally occasioned by the inability of the breaker mechanism acting via the cushioning means to firmly reseat the solenoid plunger and thereby render the solenoid magnetic force capable of detaining the plunger in its seated position against the bias of the return spring. It is found that in time increased frictional drag on the plunger movement caused by wear, dirt accumulation and misalignment can render the cushioning means incapable of reseating the plunger to the extent necessary to enable the magnetic force of the solenoid to overpower the return spring.

It is accordingly an object of the present invention to provide an improved undervoltage release device for utilization as an accessory for electric circuit breakers.

Another object of the present invention is to provide an undervoltage release device of the above character which is automatically reset incident to normal functioning of the breaker operating mechanism.

A further object is to provide an undervoltage release device of the above character which is automatically reset in an efficient and reliable manner.

Yet another object of the present invention is to provide an undervoltage release device of the above character which is uniquely constructed to provide long-lived, trouble-free operation.

Other objects of the invention will in part be obvious and in part appear hereinafter.

SUMMARY OF THE INVENTION

In accordance with the present invention, there is provided an undervoltage release (UVR) accessory device for electric circuit breaker, wherein the UVR device, upon operating to trip a circuit breaker, is automatically reset incident to normal functioning of the breaker operating mechanism to open the breaker contacts. More specifically, the present invention provides an improved UVR device which is uniquely structured such that automatic resetting of the device is achieved in a more reliable manner than has been the case heretofore.

The UVR device of the present invention includes a solenoid which, when energized under normal line voltage conditions, is capable of magnetically detaining its plunger in a seated position against the bias of a calibrated return spring. A latch lever linked to the solenoid plunger latchably engages a trip slide to return the latter in a retracted position against the bias of actuator spring so long as the plunger remains in its seated position. If the line voltage drops to an undesirably low lever for other than a momentary period, the energization of the solenoid decreases as does the magnetic force striving to detain the plunger in its seated position. The return spring overpowers the reduced magnetic force, and the plunger is pulled out to an extended position. The latch lever releases the trip slide, and the actuating spring forces the trip slide into tripping engagement with a circuit breaker latch. The breaker operating mechanism is thus tripped and it proceeds forthwith to open the breaker contacts.

To reset the UVR device of the present invention after it has operated to trip the circuit breaker, the contact opening movement of the breaker mechanism is utilized. To this end, a reset pin carried by a suitable member of the breaker operating mechanism engages and pivots a reset lever incident with opening movement of the breaker mechanism. The reset lever is coupled with the latch lever by a reset spring. Pivoting of the reset lever by the reset pin loads the reset spring which then acts to bias the latch lever toward its trip slide latching position and the solenoid plunger toward its seated position. However, such movements of the latch lever and solenoid plunger are inhibited by the trip slide. Continued movement of the reset pin during concluding contact opening movement of the breaker mechanism picks up the trip slide pursuant to returning the latter to its retracted position. Upon arrival of the trip slide at its retracted position, the motional restraint on the latch lever is abruptly removed. The reset spring discharges to move the latch lever to its latching position and, at the same time, snaps the solenoid plunger to its seated position with sufficient impact to ensure firm reseating of the solenoid plunger. The return spring maintains the plunger firmly seated, permitting the magnetic force of the solenoid to readily regain control of the plunger to detain in opposition to the bias of the return spring. With the UVR device reset, the trip slide is held latched in its retracted position while the reset pin moves to a remote position incident with resetting of the breaker mechanism. The circuit breaker may then be reclosed to restore electrical service.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings, in which.

Like reference numerals refer to corresponding parts throughout the several views of the drawings.

DETAILED DESCRIPTION

Figure 2:
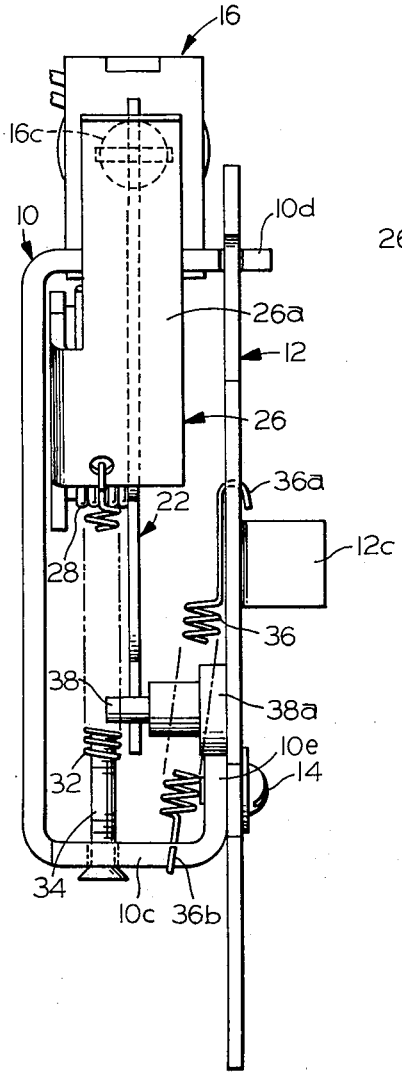
FIG. 2 is a side elevational view of the undervoltage release device of FIG. 1.
Figure 1:
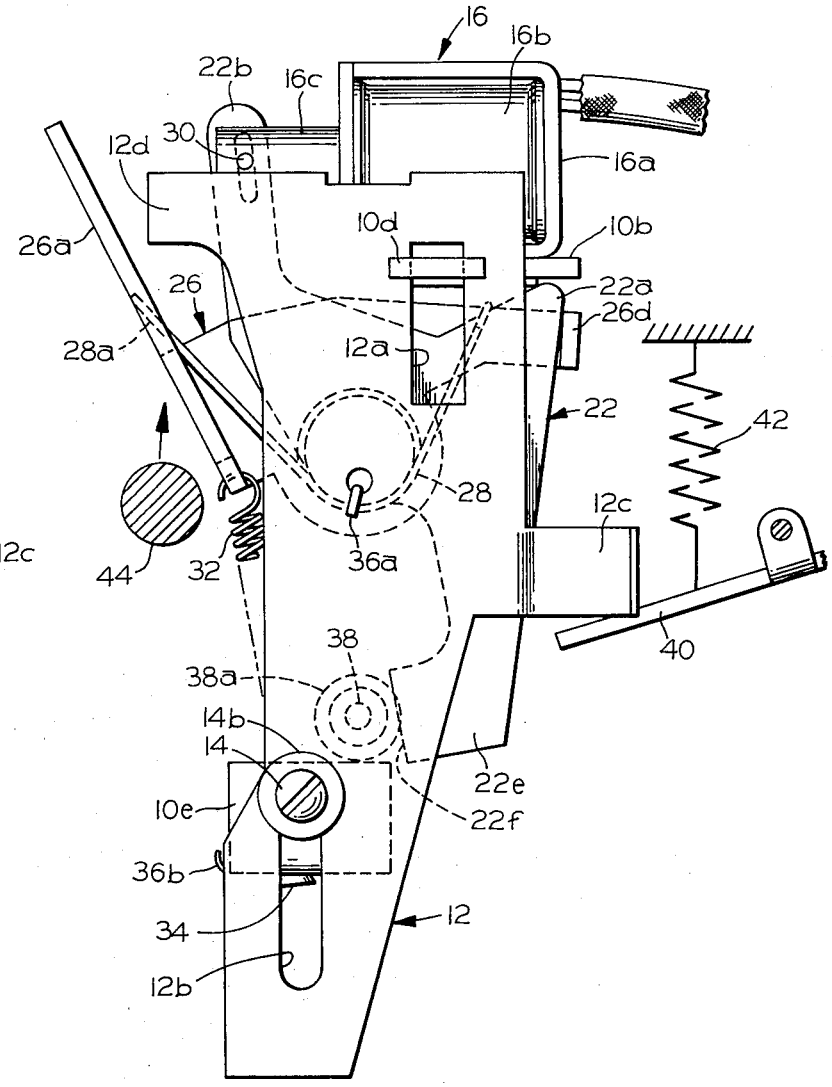
FIG. 1 is a plan view of an undervoltage release device constructed according to an embodiment of the present invention, the device being illustrated in its actuated or circuit breaker tripping condition.
Figure 3:
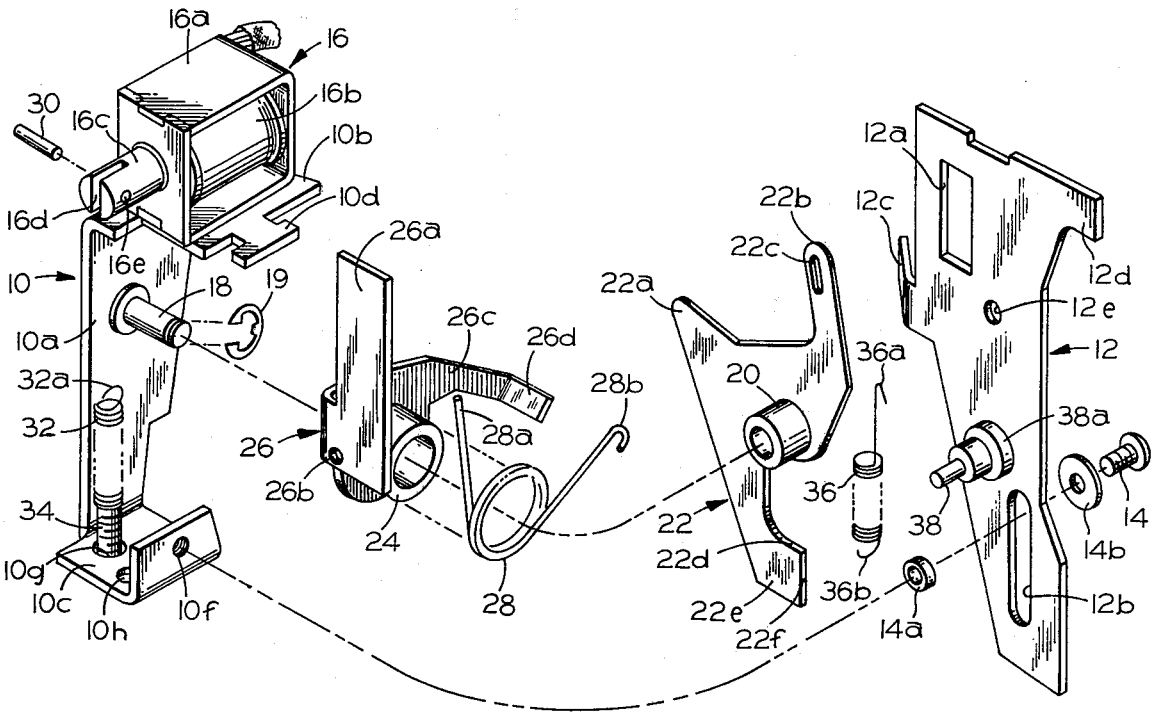
FIG. 3 is an exploded assembly view of the undervoltage release device of FIG. 1.

The undervoltage release (UVR) device of the present invention includes, as seen in FIGS. 1 through 3, a frame, generally indicated at 10, which serves to mount the various components of the device as well as to facilitate mounting attachment of the device to a circuit breaker (not shown). The frame is generally U-shaped having a bight portion 10*a* interconnecting laterally turned upper and lower legs 10*b* and 10*c*, respectively. The upper leg terminates in a tab 10*d* which is undercut to key it for receipt in a vertically elongated slot 12*a* formed in a trip slide generally indicated at 12. The lower frame leg 10*c* terminates in a turned back flange 10*e* in which is formed a tapped bore 10*f* in which is threadedly engaged a screw 14 extending through an elongated slot 12*b* also formed in trip slide 12. It is thus seen that trip slide 12 is mounted by frame 10 for vertical, reciprocating movement. Screw 14 carries a bearing ring 14*a* which rides in trip slide slot 12*b* to ensure non-binding sliding movement of trip slide 12. A washer 14*b* captured under the head of screw 14 further ensures reasonably free trip slide movement.

A solenoid, generally indicated at 16, is affixed atop upper frame leg 10*b* by suitable means such as screws (not shown). The solenoid includes a magnetic frame 16*a* which serves to mount a coil 16*b* and a reciprocating plunger 16*c*. A laterally extending post 18, mounted by the frame bight 10*a*, receives a hub 20 affixed to a latch lever, generally indicated at 22, pursuant to pivotally mounting the latch lever to the frame. Fitted over the latch lever hub 20 is a hub 24 affixed to a reset lever, generally indicated at 26. Pin 18 thus serves to independently pivotally mount latch lever 22 and reset lever 26 to the frame, the pivotal mountings being preserved by a clip 19. A torsion spring 28 is assembled with its coil mid-section supported on hub 24 of reset lever 26. One end of 28*a* of this spring acts against a laterally turned actuator arm 26*a*, integrally formed with reset lever 26, while the other end 28*b* is hooked on the edge of a projection 22*a* integrally formed with latch lever 22.

An upstanding arm 22*b* of latch lever 22 is received in a slot 16*d* formed in solenoid plunger 16*c*, with a pin 30 inserted through a transverse bore 16*e* in the solenoid plunger and a vertically elongated slot 22*c* in this upstanding arm to link together the solenoid plunger and latch lever.

A calibrated return spring 32 has its upper hooked end 32*a* engaged in a hole 26*b* in reset lever actuator arm 26*a* and its lower end threadedly engaged by a screw 34 which passes through an opening 10*g* in the lower frame leg 10*c*. It is seen that by adjustably threading screw 34 into the lower end of spring 32, the appropriate spring force acting on reset lever 26 may be conveniently established.

To power the trip slide, a tension spring 36 has its upper end 36*a* hooked in an opening 12*c* in the trip slide and its lower end 36*b* hooked in an opening 10*h* formed in the frame lower leg 10*c*.

Finally, a shouldered latch pin 38 is mounted by the trip slide 12 for lateral extension inwardly toward latch lever 22. To sustain the trip slide in its retracted position, the terminal end portion of latch pin 38 is engaged by a latch shoulder 22*d* carried by a depending leg 22*e* of the latch lever.

Figure 6:
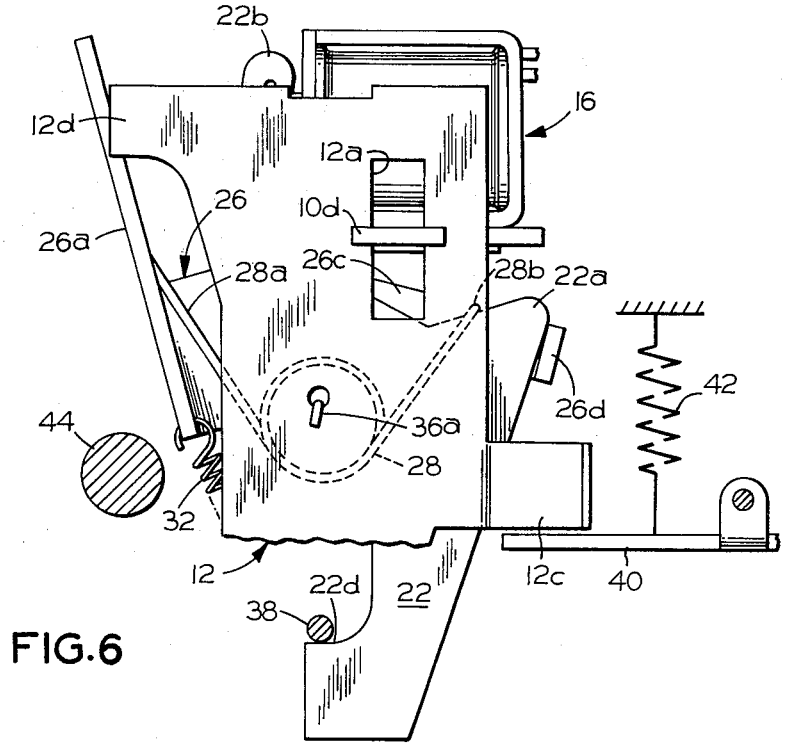
FIG. 6 is a plan view, partially broken away, of the undervoltage release device of FIG. 1, illustrated in its latched condition.

In its normal condition, the various parts of the undervoltage release device of the present invention are in their positions shown in FIG. 6. Thus, trip slide 12 is held in its retracted or inactive position against the bias of spring 36 by the engagement of latch pin 38 with latch shoulder 22*d* of trip lever 22. This clockwise-most trip slide latching position of the trip lever is sustained by solenoid 16 acting in response to normal line voltage energization to maintain its plunger 16*c* in its innermost seated position against the bias of calibrated return spring 32. It is seen that the return spring 32 acts to bias reset lever 26 in the counterclockwise direction. The reset lever includes an arm 26*c* which terminates in a laterally turned tab 26*d* positioned to engage the edge of latch lever projection 22*a* of the latch lever, and thus spring 32 also biases the latch lever in the counterclockwise direction via the reset lever. Torsion spring 28, acting between the reset and latch levers sustains the relative angular orientations shown in FIG. 6 with latch lever projection 22*a* abutting reset lever tab 26*d*.

While the trip side is latched in its retracted, inactive position against the bias of spring 36, a laterally extending arm 12*c* is held poised above a trip lever 40 included in a circuit breaker trip mechanism (not shown). The trip lever is normally biased to an elevated, non-tripping position by a spring 42. When the line voltage falls to an abnormally low level for longer than a momentary interval, the magnetic force developed by the solenoid striving to hold the plunger in its seated position decreases to the point where return spring 32 becomes overpowering. Reset lever 26 is thus pivoted by this spring in the counterclockwise direction, and the reset lever tab 26*d* picks up the latch lever, pivoting it also in the counterclockwise direction to a position determined by abutment of projection 22*a* with upper frame leg 12*a*. The latch shoulder 22*d* is thus swung to the right as seen in FIG. 6, releasing trip slide 12. Spring 36 pulls the unlatched trip slide downward, bringing arm 12c into tripping engagement with the circuit breaker latch 40.

The tripping condition of the UVR device is shown in FIG. 1, with trip slide 12 in its lowermost, tripping position, determined by abutment of latch pin shoulder 38a against the upper edge of frame flange 10e. It is seen that trip slide arm 12c engages and holds the circuit breaker latch 40 in its depressed, tripped position, thus preventing the circuit breaker operating mechanism (not shown) from being reset pursuant to reclosure of the breaker contacts. Latch lever 22 and reset lever 26 coupled together by reset spring 28 are jointly pivoted to their counterclockwise-most positions by return spring 32, with the latch lever pulling solenoid plunger 16c out to its extended position.

Figure 4:
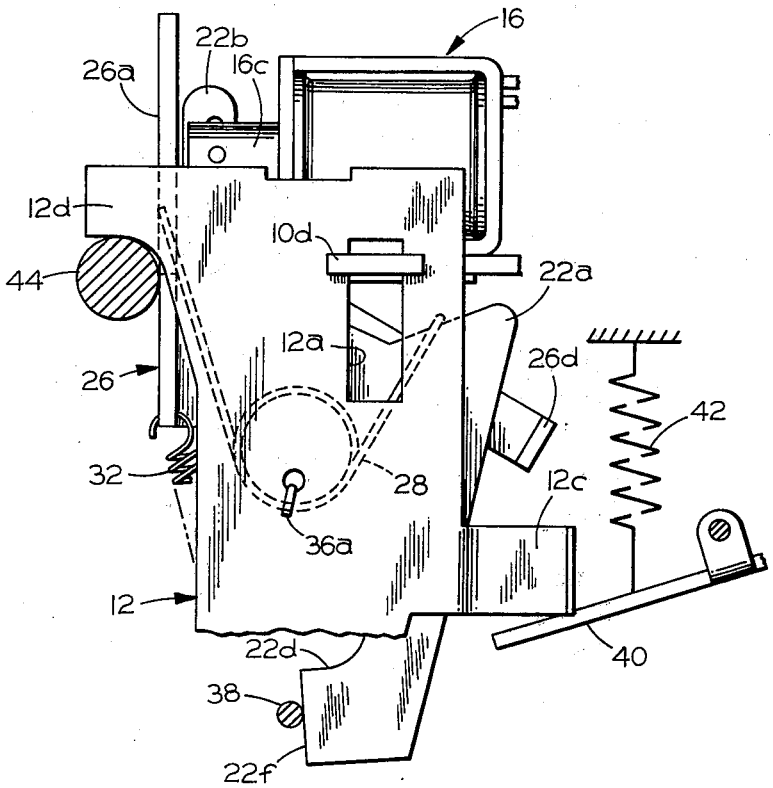
FIG. 4 is a plan view, partially broken away, of the undervoltage release device of FIG. 1, illustrated in a partially reset condition.

During opening movement of the breaker mechanism, a pin 44 carried by an element of the breaker mechanism, such as the mechanism cradle, moves upwardly and slightly to the right in an arcuate path into engagement with actuating arm 26a of reset lever 26. Continued upward movement of pin 44 pivots the reset lever around in the clockwise direction. By virtue of torsion spring 28, the clockwise pivotal movement of reset lever 26 is communicated to latch lever 22. However, the latch lever only moves through a small arc in the clockwise direction before a flat nose 22f carried by the latch lever arm 22e immediately below latch shoulder 22d encounters latch pin 38 of trip slide 12. Consequently, continued pivotal movement of the reset lever in the clockwise direction by pin 44 is not accompanied by continued clockwise pivotal movement of latch lever 22, and the reset spring 28 becomes loaded. With the nose 22f of the latch lever abutting the trip slide latch pin, solenoid plunger 16c is constrained from further movement toward its seated position. The positions of the various parts with the device in this intermediate reset condition are seen in FIG. 4.

Figure 5:
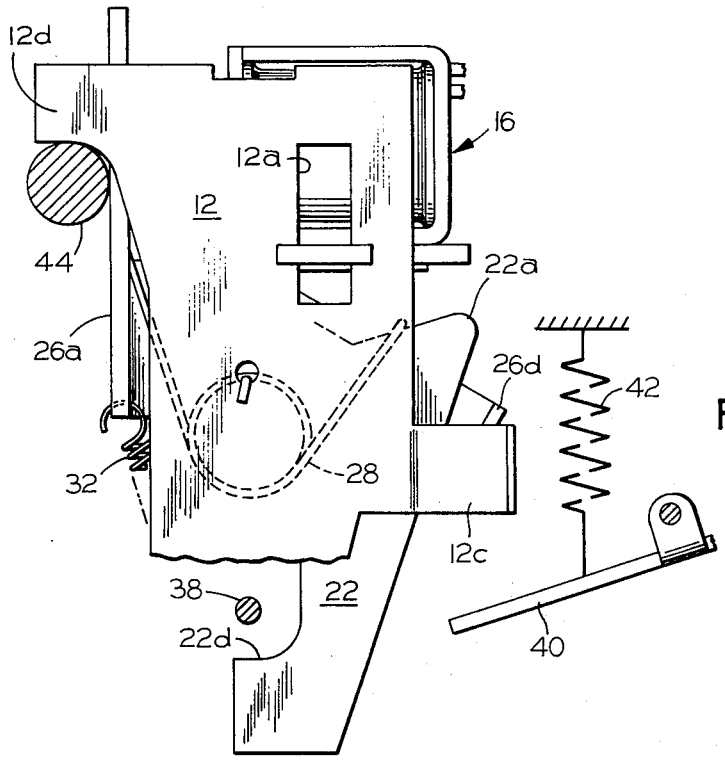
FIG. 5 is a plan view, partially broken away of the undervoltage release device of FIG. 1, illustrated in its fully reset condition.

Turning to FIG. 5, with continued upward movement of pin 44, an ear 12d extending laterally from the upper left corner of trip slide 12 is picked up by the reset pin, raising the trip slide upwardly toward its retracted position. Latch pin 38 rides upwardly along nose 22f, and upon reaching latch shoulder 22d, it is seen that latch lever 22 is then suddenly released for clockwise pivotal movement by reset spring 28. Plunger 16c is abruptly and forcefully propelled to its seated position concomitantly with the clockwise pivotal movement of the latch lever. This snap action ensures that the solenoid plunger is firmly reseated under conditions that have heretofore defeated the resetting of prior art UVR devices. Moreover, with the parts in their positions shown in FIG. 5, reset spring is not fully discharge and thus is effective to hold the plunger in its seated position pending restoration of normal line voltage.

With the resetting of the breaker operating mechanism, reset pin 44 moves downwardly to its position shown in FIG. 6, thus releasing the trip slide and the actuator arm of reset lever 26. If the undervoltage condition has not been corrected, release of the actuator arm by pin 44 will allow return spring 32 to pull the solenoid plunger out of its extended position, thereby pivoting latch lever 22 in the counterclockwise direction to release trip slide 12. The trip slide immediately moves downwardly to trippingly engage the circuit breaker latch 40 and resetting of the breaker mechanism is defeated. However, if the undervoltage condition has been corrected, the magnetic force of the solenoid 16 will retain plunger 16c in its seated position against the bias of return spring 32, and latch lever 22 remains in its clockwise-most position with latch shoulder 22d latchably engaging latch pin 38 to hold the trip slide in its retracted position. Arm 12c of the trip slide is thus held out of tripping engagement with the circuit breaker latch 40, and the breaker mechanism can then be reset pursuant to reclosure of the breaker contacts.

From the foregoing description, it is seen that the construction of the present invention accommodates considerable overtravel of reset pin 44 in resetting the undervoltage release device. Specifically, FIG. 5 illustrates an appreciable degree of reset pin overtravel which simply results in further elevation of the trip slide; such further slide movement being readily accommodated by the elongation of slots 12a, 12b. Moreover, it is seen that actuator arm 26a is at this point oriented almost tangential to the reset pin path of movement, and thus reset pin overtravel results in very little additional clockwise pivotal movement of the reset lever; such additional movement simply serving to increase the force of spring 28 holding the plunger in its seated position.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desired to secure by Letters Patent is:

1. An undervoltage release device for tripping an electric circuit breaker automatically in response to an abnormal undervoltage condition, said device comprising, in combination:

A. a frame for mounting attachment to a circuit breaker;

B. a trip member mounted by said frame for movement between a latched position and a circuit breaker tripping position, said trip member being spring-biased to said tripping position;

C. a solenoid mounted by said frame, said solenoid having

1. a plunger movable between a seated position and an extended position, and

2. a coil for developing a magnetic force sustaining said plunger in its seated position under normal line voltage conditions;

D. a latch member linked to said plunger and mounted by said frame for movement from a first position latching said trip member in its latched position and a second position in response to movement of said plunger from its seated position to its extended position, thereby releasing said trip member for movement to its tripping position;

E. a first spring calibrated to overpower the magnetic force of said solenoid in the event of an abnormal undervoltage condition such as to move said plunger to its extended position and said latch member to its second position;

F. a reset member mounted by said frame for movement from a normal position to a reset position;

G. a second spring positioned to be charged by movement of said reset lever to its reset position, said charged second spring biasing said plunger to its seated position; and H. means carried by said trip and latch members for inhibiting movement of said plunger to its seated position under the bias of said second spring until said trip member is fully returned from its tripping position to its latched position, whereupon said second spring abruptly discharges to snap said plunger to its seated position and said latch member to its first position.

2. The undervoltage release device of claim 1, wherein said first spring acts in tension between said reset member and said frame to bias said reset member to its normal position, said reset member including a tab positioned to engage said latch member and thereby render said first spring operative to bias said plunger to its extended position and said latch member to its second position.

3. The undervoltage release device defined in claim 2, which further includes a pivot post mounted by said frame, said pivot post independently pivotally mounting said latch and reset levers.

4. The undervoltage release device defined in claim 3, wherein said second spring is in the form of a torsion spring mounted with said latch and reset members on said pivot post, said torsion spring biasing said latch and reset members in opposite pivotal directions.

5. The undervoltage release device defined in claim 1, wherein said means carried by said trip and latch members comprises a latch pin carried by said trip member and a nose surface carried by said latch member, said latch pin engaging said nose surface during return movement of said trip member toward its latched position to thereby inhibit movement of said latch member to its first position and said plunger to its seated position.

6. The undervoltage release device of claim 5, wherein said latch member carries a latch shoulder angled sharply away from the termination of said nose surface, with said latch member in its first position and said trip member returned to its latched position, said latch shoulder engaging said latch pin to detain said trip member in its latched position.

7. The undervoltage release device defined in claim 1, wherein said reset member carries an actuating arm and said trip member carries an ear, said arm and ear being disposed for engagement by a part of the circuit breaker mechanism as the latter operates to open the breaker contacts, whereby said reset member is moved to its reset position by the breaker mechanism part before said trip member is fully returned to its latched position by the breaker mechanism part.

8. The undervoltage release device defined in claim 7, wherein said means carried by said trip and latch members comprises a latch pin carried by said trip member and a nose surface carried by said latch member, said latch pin engaging said nose surface during return movement of said trip member toward its latched position to thereby inhibit movement of said latch member to its first position and said plunger to its seated position.

9. The undervoltage release device of claim 8, wherein said latch member carries a latch shoulder angled sharply away from the termination of said nose surface, with said latch member in its first position and said trip member returned to its latched position, said latch shoulder engaging said latch pin to detain said trip member in its latched position.

10. The undervoltage release device of claim 9, wherein said first spring acts in tension between said reset member and said frame to bias said reset member to its normal position, said reset member including a tab positioned to engage said latch member and thereby render said first spring operative to bias said plunger to its extended position and said latch member to its second position.

11. The undervoltage release device as defined in claim 10, which further includes a pivot post mounted by said frame, said pivot post independently pivotally mounting said latch and reset levers.

12. The undervoltage release device defined in claim 11, wherein said second spring is in the form of a torsion spring mounted with said latch and reset members on said pivot post, said torsion spring biasing said latch and reset members in opposite pivotal directions.

* * * * *